US006824115B1

(12) United States Patent
Batson

(10) Patent No.: US 6,824,115 B1
(45) Date of Patent: Nov. 30, 2004

(54) PAINT TRAY HOLDER

(76) Inventor: Richard Batson, 665 Riverview Dr., Totowa, NJ (US) 07512-1716

( * ) Notice: Subject to any disclaimer, the term of this patent is extended or adjusted under 35 U.S.C. 154(b) by 0 days.

(21) Appl. No.: 10/401,348

(22) Filed: Mar. 28, 2003

(51) Int. Cl.[7] ..... E06B 7/28
(52) U.S. Cl. ..... 248/238; 182/129
(58) Field of Search ..... 248/210, 238; 182/129; D25/68; 220/737, 756, 771, 754

(56) References Cited

U.S. PATENT DOCUMENTS

| | | | | |
|---|---|---|---|---|
| 3,223,369 | A | 12/1965 | Benninger, Jr. | |
| 3,822,846 | A | 7/1974 | Jesionowski | 248/210 |
| 4,099,693 | A | 7/1978 | Blann | 248/210 |
| 4,186,903 | A | 2/1980 | Fazakerley | 248/210 |
| 4,445,659 | A | 5/1984 | LaChance | 248/210 |
| 4,478,349 | A | * 10/1984 | Haverland et al. | 220/573.4 |
| 4,523,733 | A | 6/1985 | Lunden, Jr. | 248/210 |
| 4,660,794 | A | 4/1987 | Given | 248/238 |
| 4,662,594 | A | 5/1987 | Dubis | 248/238 |
| 4,702,446 | A | 10/1987 | Brown | 248/210 |
| 5,135,193 | A | 8/1992 | Parris | 248/238 |
| 5,236,161 | A | 8/1993 | Haven | 248/210 |
| 5,259,525 | A | * 11/1993 | Wion | 220/737 |
| 5,293,957 | A | * 3/1994 | Lunden, Jr. | 182/129 |
| D396,011 | S | * 7/1998 | Henriksson | D10/46.2 |
| 5,836,557 | A | * 11/1998 | Bailey et al. | 248/210 |
| 5,971,103 | A | * 10/1999 | Mulvaney | 182/129 |
| 6,260,663 | B1 | * 7/2001 | Combs | 182/129 |
| 6,352,135 | B1 | 3/2002 | Jones | 182/129 |
| 6,474,607 | B1 | 11/2002 | Wilson | 248/211 |

* cited by examiner

*Primary Examiner*—Korie Chan
(74) *Attorney, Agent, or Firm*—Siegmar Silber, Esq.

(57) ABSTRACT

A tray holding device for mounting to a D-rung ladder is disclosed. The mounting shaft inserts into an outwardly facing D-shaped aperture of the ladder and slidably engages the inner wall of the rung. In one embodiment, the shaft is D-shaped and fits telescopically within the D-rung opening. Optionally, the shaft is molded in a slightly bowed condition and, when in use, is under flexural tension. Alternatively, molded into the thermoplastic tray-holding portion is an extruded metal shaft. The shaft configurations shown engage the interior wall of the rung cavity and preclude rotation. Some shaft configurations engage both the flat side and the curved side of the D-rung cavity and enable the tray holding device to be reversibly insertable into a rung cavity.

12 Claims, 6 Drawing Sheets

PAINT TRAY HOLDER

BACKGROUND OF THE INVENTION

1. Field of the Invention

This invention relates to an accessory for a D-rung ladder and, more particularly, to a paint tray holder for such ladders.

2. Description of the Prior Art

Many devices have been proposed from time-to-time to assist craftsmen overcome any awkwardness when working on a ladder. During the past decades, ladders have seen changes from wooden extension ladders to those of extruded aluminum and other composite materials. The extruded aluminum ladders initially replicated the wooden ladders and had round rungs that were swaged or otherwise attached to the extruded side rails.

The early accessories were designed to be accommodated by the ladder construction and, as cylindrical, hollow rungs came into use, several devices were adapted to function cooperatively with one or more rungs. These devices had varying degrees of adaptability and adjustability and are described hereinbelow in the review of the patent art known to the inventor. These devices are generally difficult to manufacture, expensive to acquire, and awkward to mount.

As ladder manufacturing technology evolved standards for safety were developed and relevant American National Standards Institute (ANSI) standards developed. One ANSI standard indicates, for example, that the optimal angle for setting up a ladder is 75° (approx.). Other safety and manufacturing restraints have been promulgated.

In the 1980's and 1990's, the use of D-shaped rungs became more widespread and prompted patents such as Werner, U.S. Pat. No. 4,656,721 and Thompson et al., U.S. Pat. No. 5,317,798. These described methods of manufacturing D-rung ladders and led to further acceptance of the newer, safer ladders. In the recent past, extruded aluminum ladders were manufactured with C-side rails and round hollow rungs. Such ladders had inherent safety drawbacks, as delineated by Thompson et al. in U.S. Pat. No. 5,317,798. To overcome these safety drawbacks of cylindrical rungs, non-cylindrically shaped rungs developed with the preferred form being the D-shaped rung—known as the D-rung.

In a D-rung ladder, the rungs are set into a D-shaped aperture in the side rail with the flat side of the rung positioned at an angle, typically 15° (approx.), to the horizontal plane of the ladder when the ladder is vertically disposed. Then, as described above, with the ladder set at the optimal operative angle, against a vertical surface, the D-rung angle is complementary thereto and the flat or step side of the D-rung is substantially horizontal and parallel to the ground. In addition, the D-rung provides more safety as rotation within the mounting hole in the side rail is precluded. The popularity of the D-rung ladder has grown as the configuration provides more comfort to a person standing on the rung for an extended period of time than did the older style round-rung ladders.

In preparing for this disclosure, several patents became known to the inventor hereof and include the following:

| Patent | Inventor | Issue Date |
|---|---|---|
| 6,474,607 | Wilson | November 5, 2002 |
| 6,352,135 | Jones | March 5, 2002 |
| 5,236,161 | Haven | August 17, 1993 |
| 5,135,193 | Parris | August 4, 1992 |
| 4,702,446 | Brown | October 27, 1987 |
| 4,662,594 | Dubis | May 5, 1987 |
| 4,660,794 | Given | April 28, 1987 |
| 4,523,733 | Lunden, Jr. | June 18, 1985 |
| 4,445,659 | LaChance | May 1, 1984 |
| 4,186,903 | Fazakerley | February 5, 1980 |
| 4,099,693 | Blann | July 11, 1978 |
| 3,822,846 | Jesionowski | July 9, 1974 |
| 3,223,369 | J.A. Benninger, Jr. | December 14, 1965 |

Wilson—U.S. Pat. No. 6,474,607—issued Nov. 5, 2002

Wilson describes paint container support device which includes a hook to suspend the paint can from a rung and an elongate holding arm for insertion into a hollow rung to suspend the paint can therefrom. The holding arm has a configuration consistent with the D-rungs of a modern extension ladder.

Jones—U.S. Pat. No. 6,352,135—issued Mar. 5, 2002

Jones discloses an accessory device for installation on a ladder having hollow rungs. The device includes a holding arm shaped to be inserted within the ladder rung and the arm has a flat top to prevent rotation thereof. The holding arm is hollow and mounted within one end thereof is a leveling ratchet assembly for rotating an assembly coupled thereto.

U.S. Pat. No. 5,236,161—Haven—issued Aug. 17, 1993

Haven discloses a paint roller tray releasably attached to a side rail of the ladder by means of a bracket and clamping mechanism, the clamping mechanism being releasably engagable to either side rail and slidable along the slide rail as the painter moves up and down the ladder.

U.S. Pat. No. 5,135,193—Parris—issued Aug. 4, 1992

Parris discloses a tray assembly for attachment to two adjacent hollow rungs. A primary means of attachment is provided by a shaft passing through the uppermost of the two hollow rungs and on the opposite side from the tray a clip is attached. A secondary connector is an L-shaped support that depends from the shaft and inserts into the lowermost hollow rung.

U.S. Pat. No. 4,702,446—Brown—issued Oct. 27, 1987

Brown discloses a ladder caddy designed to support a paint pail and paint brush. The entire fixture is held to the ladder simply by inserting the tubular holding arm into a rung of the ladder. The device has a metal band that fastens about the paint pail. The device depends from a round tube mounted in a round rung to maintain the paint level in a horizontal plane.

U.S. Pat. No. 4,662,594—Dubis—issued May 5, 1987

Dubis discloses a tray attached to a ladder having hollow, round rungs to provide a tray or work base for use while working on the ladder. The device has an expandable member which is placed within the rung. This expandable member functions like an expansion bolt, in than in an unexpanded condition has a diameter which is slightly smaller than the inner diameter of the rung, and, upon expansion, presses against the interior wall of the rung.

U.S. Pat. No. 4,660,794—Given—issued Apr. 28, 1987

Given discloses a ladder tray mounted in one hollow rung of the ladder, which tray is adjustable so as to be held to a nearly level position regardless of the angle of the ladder. On the side of the ladder opposite the tray, a stabilizer block engages the rail of the ladder.

U.S. Pat. No. 4,523,733—Lunden. Jr.—issued Jun. 18, 1985

Lunden discloses a paint or stain can holder which is suspended from a rod having an outside diameter of one inch to fit within a round hollow rung.

U.S. Pat. No. 4,445,659—LaChance—May 1, 1984

LaChance discloses a paint tray holder that, in a manner similar to Parris, supra, attaches to two rungs of the ladder. The tray is adjustable so that it can be always level relative to the ground or in any other angular position, regardless of the angle at which the ladder is placed against a structure.

U.S. Pat. No. 4,186,903—Fazakerley—issued Feb. 5, 1980

Fazakerley discloses a spring insert for a hollow rung with the insert having an upper leaf and a lower leaf, which lower leaf extends beyond the side rail of the ladder and terminates in a lip section for receiving the bail of a paint can and a hook thereabove for a paint brush.

U.S. Pat. No. 4,099,693—Blann—issued Jul. 11, 1978

Blann discloses a hook formed from a ⅜-inch steel rod for holding a paint can. The hook has a stem extended through a hollow rung from side rail to side rail with a catch at one end and a hanger at the other. The hanger includes a flange to support the side of the paint can.

U.S. Pat. No. 3,822,846—Jesionowski—issued Jul. 9, 1974

Jesionowski discloses a paint tray which in one embodiment is mounted on a ladder by a clamp about the surface of a tread of a wooden ladder and in a second embodiment is mounted by a cam locking member into a hollow rung. The cam locking device has a offset cam rod constructed to bear against the interior wall of the hollow rung.

U.S. Pat. No. 3,223,369—J. A. Benninger. Jr.—issued Dec. 14, 1965

Benninger discloses a paint can hanger having a tubular member with a wire spring lock that fit within the round, hollow rung and a grooved boss that extends beyond the side rail.

These patents are representative of the present state-of-the-art, but do not singly or in combination exhibit the characteristics of the paint tray holder presented, infra. The citing of the above patents is not intended as an admission that any such patent constitutes prior art against the claims of the present application. Applicant does not waive any right to take any action that would be appropriate to antedate or otherwise remove any listed document as a competent reference against the claims of the present application.

Other technical problems are overcome or resolved by the invention disclosed herein. The innovative approach becomes apparent in the description which follows.

SUMMARY

The invention disclosed hereby is a tray holding device for mounting to a D-rung ladder. The device has a shaft adapted to be inserted into an outwardly facing D-shaped aperture of the ladder and to slidably engage the inner wall of the hollow D-rung. A tray extends from the shaft and, when installed in the D-rung of a ladder in an operative position, is disposed substantially horizontally. In one embodiment of the invention, a tray holding device has a mounting shaft that is D-shaped in cross-section and configured to telescopically fit within a D-shaped opening of a hollow rung. Optionally, as this is fabricated from reinforced thermoplastic material, the shaft is molded in a slightly bowed condition and, when in use, is under flexural tension.

Alternatively, in another embodiment, molded into the thermoplastic portion of the disclosed device is an extruded metal shaft. Here, any number of cross-sectional configurations may be chosen, which slidably engage the interior wall of the rung cavity. Several of these mounting shafts engage both the flat side and the curved side of the D-rung cavity and enable the tray holding device to be reversibly insertable into one of the D-shaped openings. The cross-sectional configurations shown all preclude rotation within the D-rung while permitting reversibility.

Because of the fabrication techniques employed, tray support structures are described which buttress the underside of the tray and enhance the load carrying capacity of the paint tray holder.

OBJECTS AND FEATURES OF THE INVENTION

It is an object of this invention to provide a paint tray accessory for installation on a ladder having D-shaped rungs.

It is another object of this invention to provide a paint tray accessory which is economically manufactured by injection molding from a thermoplastic material.

It is yet another object of this invention to provide a paint tray accessory which is readily insertable into a D-rung of a ladder.

It is a feature of this invention that the use of the D-rung cavity prevents unwanted rotation of the paint tray accessory.

It is another feature of this invention that the paint tray holder may be reversible with (or without) a low-raised edge on one side and a high-raised edge on the other.

It is yet another feature of this invention that the shaft inserted into the D-rung, while being under tension, is readily released therefrom for placement at another location.

Other objects and features of this invention will become apparent from the following drawings and Description of the Preferred Embodiments set forth hereinbelow.

BRIEF DESCRIPTION OF THE DRAWING

In the following drawing, the same parts in the various views are afforded the same reference designators.

DESCRIPTION OF THE PREFERRED EMBODIMENTS

Prior to describing the preferred embodiments, it is noted that the devices hereof are adapted for use with D-rung ladders, see supra. The applicable ANSI standards define an operative position for a ladder as being set at 75° (approx.) to horizontal and thus, canting the D-rungs at a 15° angle in the side rails, ensures horizontal positioning of the treads during use. In the following, the use of operative position for a ladder indicates a ladder set against a wall at 75° (approx.) in compliance with ANSI A14.2.

For mounting the tray holding devices hereof, the embodiments hereof utilize the D-rung openings of the D-rung ladders, which openings are on the outwardly facing sides of the ladder side rails. In the following, the use of rung cavity indicates the space or volume within the hollow of the D-rung bounded by the interior wall and the D-rung openings or apertures at either end thereof.

Figure 1:
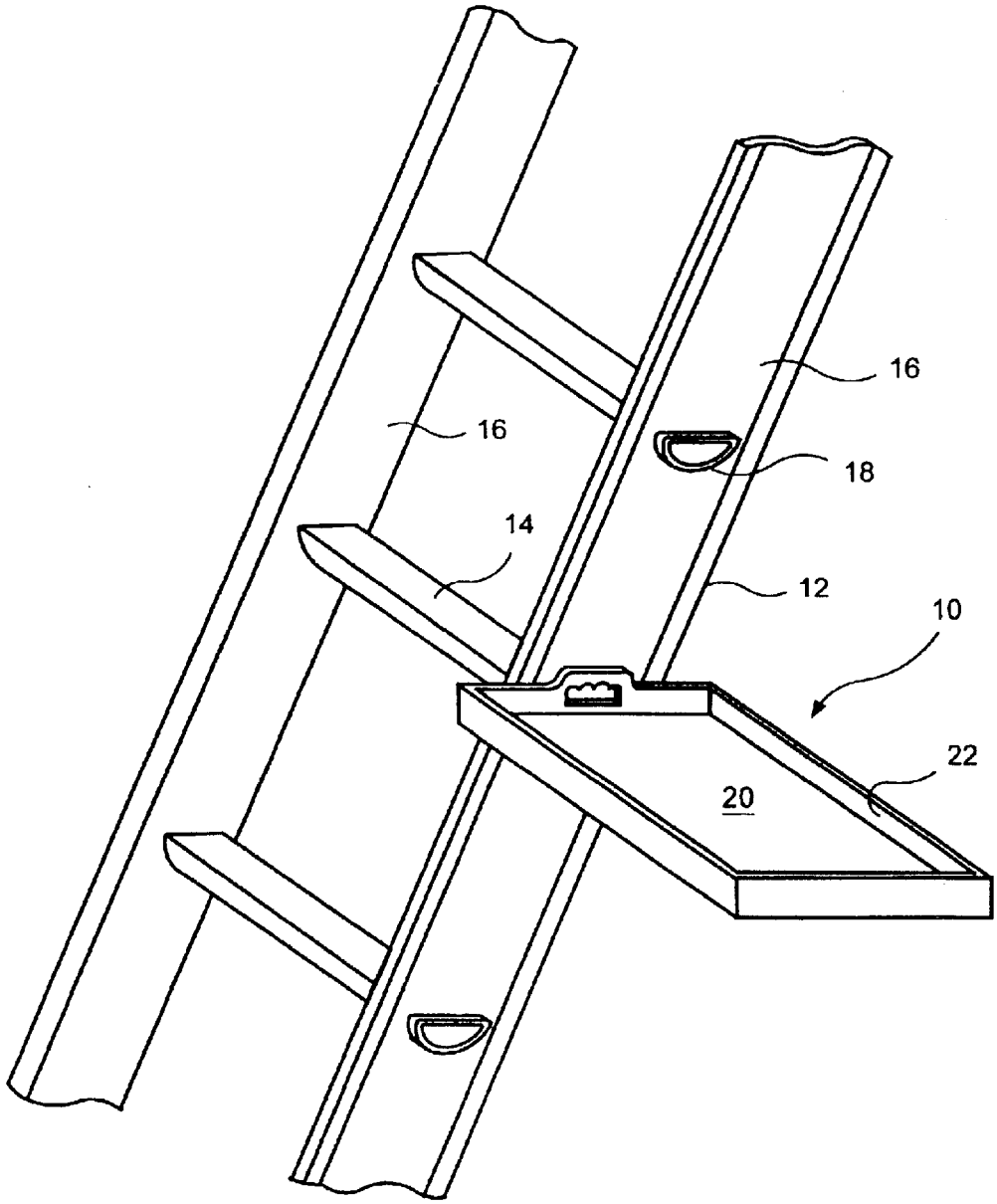
FIG. 1 is a perspective view of the paint tray holder of the present invention mounted on a D-rung ladder.
Figure 2:
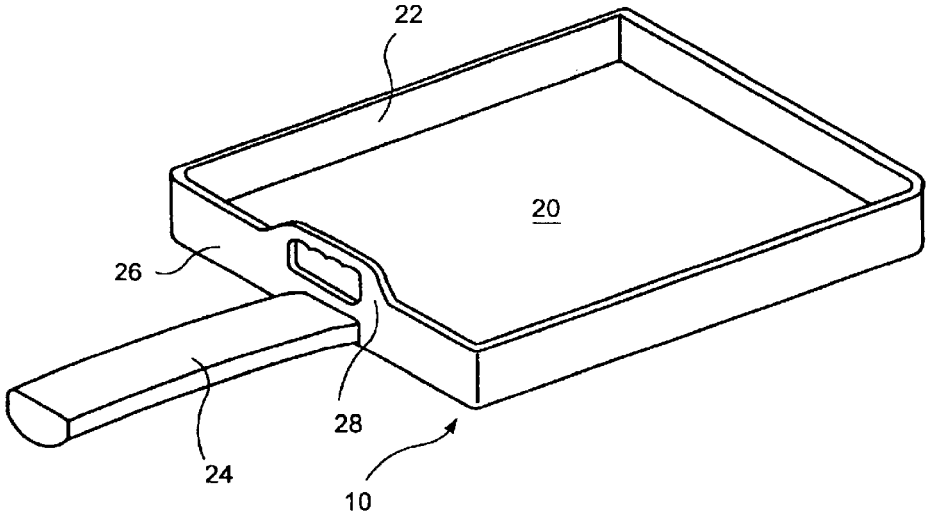
FIG. 2 is a perspective view from above of the embodiment shown in FIG. 1.
Figure 3:
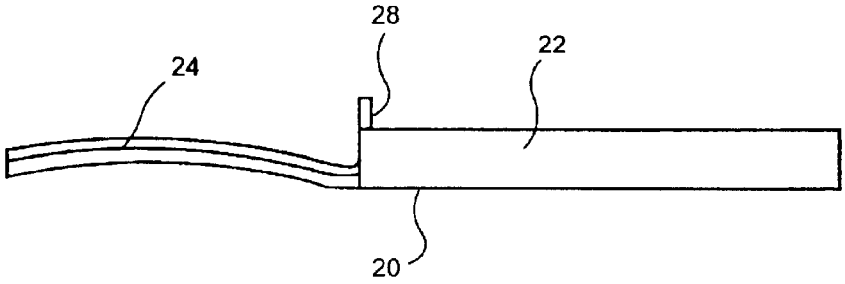
FIG. 3 is a side elevational view of FIG. 2 and shows the mounting shaft slightly bowed.

-Referring now FIGS. 1 through 5, the first embodiment of the paint tray holder or tray holding device of this invention is shown and is referred to generally by the reference designator 10. The device is a unique tray holding accessory for a D-rung ladder 12. In FIG. 1, the tray holding device 10 is mounted in D-rung 14 of ladder 12. The hollow D-rungs 14 extend between a pair of spaced apart side rails 16 and terminate on the outwardly facing sides of the rails 16 at D-rung openings or apertures 18. In ladder manufacture the ends of the D-rungs 14 are splayed outwardly and swaged over about a collar onto the side rails so as to provide mechanically uniform entryways into the rung cavities.

Although the tray holding device of the first embodiment is shown as an injection molded, one-piece unitary structure, it is understood that it can be formed from discrete components of almost any acceptable, preferably nonconductive, material. Here, a light-weight tray 20 is formed from a reinforced thermoplastic material. The tray 20 is optionally equipped with an upstanding rim 22 about the perimeter thereof, the height of which is arbitrary.

The device 10 includes a mounting shaft 24 extending from one side of the tray 20. The shaft 24 is correspondingly shaped to fit telescopically within the respective the selected D-rung opening 18 and to slidingly engage the interior wall of the rung cavity. In the first embodiment the shaft 24 when molded is slightly bowed, and, when inserted in the cavity is straightened, exerting flexural tension upon the interior wall of the cavity. With the mounting shaft emplaced in the rung cavity and fully inserted thereinto, the side 26 of rim 22 abuts side rail 16 adding stability to the installation. Upon installation on a ladder in the operative position, the tray holding device 10 of this invention is horizontal.

As shown herein, side 26 further includes handgrip or handle 28 which is constructed to rest against side rail 16 and thereby not to protrude into the work area. The handgrip 28 facilitates one-handed mounting and demounting of the tray holding device 10 by an operator and enables the operator to hold onto the ladder with his or her free hand.

Figure 4:
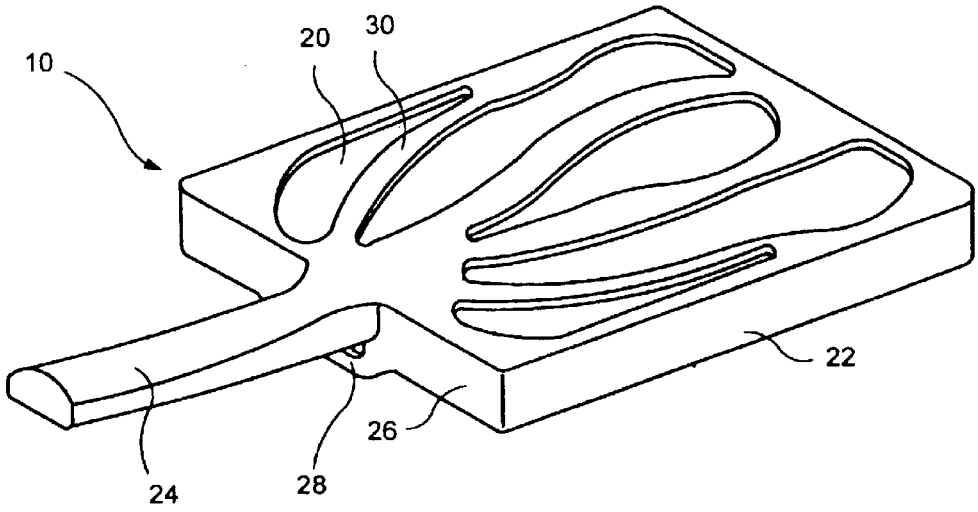
FIG. 4 is a perspective view from below of the embodiment shown in FIG. 1 and shows the tray support structure.
Figure 5:
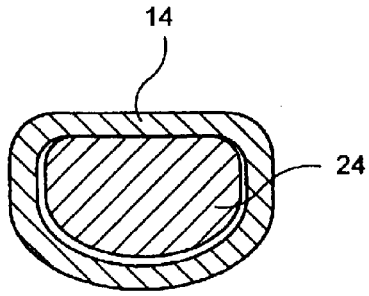
FIG. 5 is a cross-sectional view of the D-rung with the mounting shaft of the first embodiment therewithin and showing the relationship therebetween.
Figure 6:
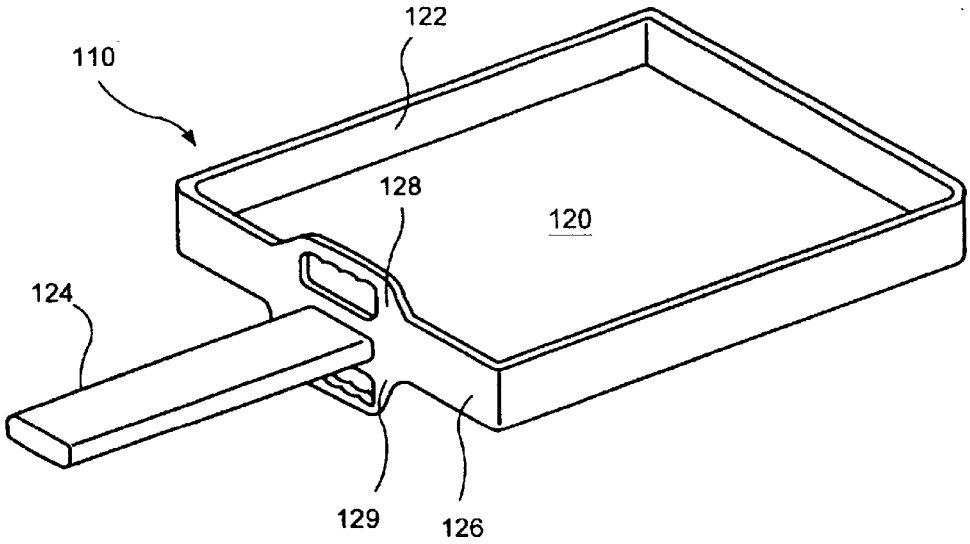
FIG. 6 is a perspective view of a second embodiment of the paint tray holder of the present invention, similar to FIG. 1, but being reversibly mountable with a raised rim on one side and no rim on the other side.
Figure 7:
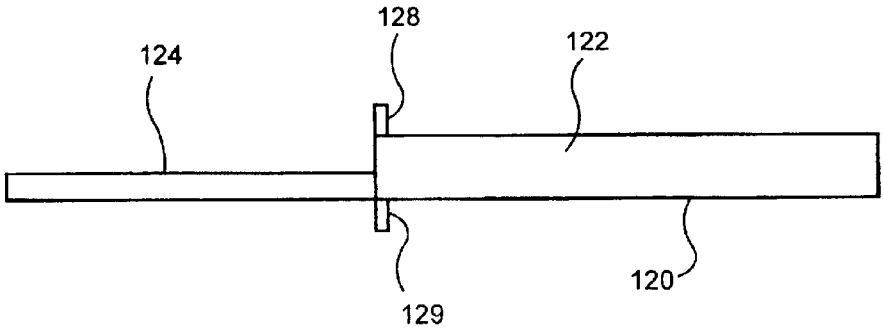
FIG. 7 is a side elevational view of FIG. 6.

When a device such as the one shown in the drawings is molded from a thermoplastic, reinforced thermoplastic, or other moldable material, to accommodate loads it is constructed with an undergirding support structure. In the first embodiment this is shown in FIG. 4 and includes finger-like projections 30 extending from the mounting shaft 24 across the bottom of tray 20. Although shown in this configuration, it is understood that the support structure could take the form of ribs, vanes, corrugations and the like.

Referring now to FIGS. 6 through 9, the second embodiment of this invention in which a reversible tray accessory, referred to generally by the reference designator 110, is shown. In this embodiment, similar parts to those of the first embodiment are referred to by reference designators 100 units higher than a similar part in the first embodiment. Thus, for example, the mounting shaft 24 in the first embodiment has an analogous mounting shaft 124 in the second embodiment.

Although the reversible tray accessory of the second embodiment is shown as an injection molded with a mounting shaft insert, it is understood that it can be formed from additional discrete components of almost any acceptable, preferably nonconductive, material. Here, a light-weight reversible tray 120 is formed from a reinforced thermoplastic material. On one side, the tray 120 is optionally equipped with an upstanding rim 122 about the perimeter thereof, the height of which is arbitrary. On the other side, no rim is provided. While shown in this manner, the combinations of tray arrangements are innumerable in that one side can be equipped with a compartmental arrangement for small hardware with the other side with or without a rim; different height rims can be combined.

Figure 9A:
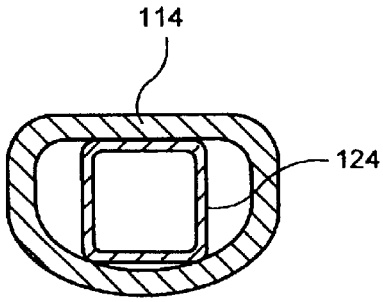
FIGS. 9A, 9B and 9C are cross-sectional views of the D-rungs with the mounting arm of various configurations therewithin to show the relationship therebetween; and, FIG. 10 is an application of the paint tray holder this invention with the rim thereof dimensioned to support a standard paint tray.
Figure 9B:
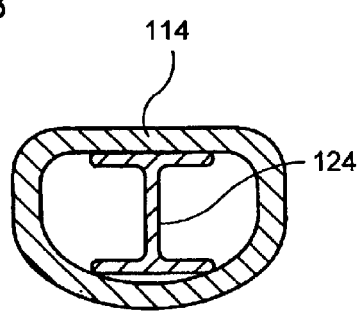
Figure 9C:
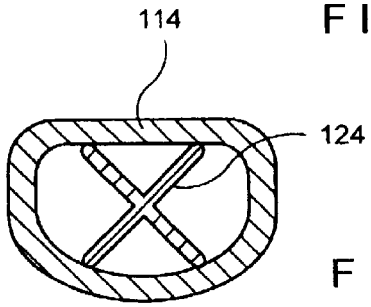

The device 10 includes a mounting shaft 124 extending from one side of the tray 120. The shaft 124 is correspondingly shaped to slidingly engage the interior wall of the rung cavity of the respective D-rung opening selected. The cross-sectional forms of FIGS. 9A, 9B and 9C are all of mounting shafts 124 that are reversibly mountable in the rung cavity of a D-rung 114 and are metal, preferably aluminum, extrusions about which the tray 120 can be molded. With the mounting shaft 124 emplaced in the rung cavity and fully inserted thereinto, the side 126 of rim 122 abuts side rail adding stability to the installation. Upon installation on a ladder in the operative position, the reversible tray accessory 110 of this invention is horizontal;

As shown herein, side 126 further includes upper and lower handgrips or handles 128 and 129 which are constructed to rest against side rail and thereby not to protrude into the work area. The handgrips 128 and 129 facilitate one-handed mounting and demounting of the tray holding device 110 by an operator and enables the operator to hold onto the ladder with his or her free hand.

Figure 8:
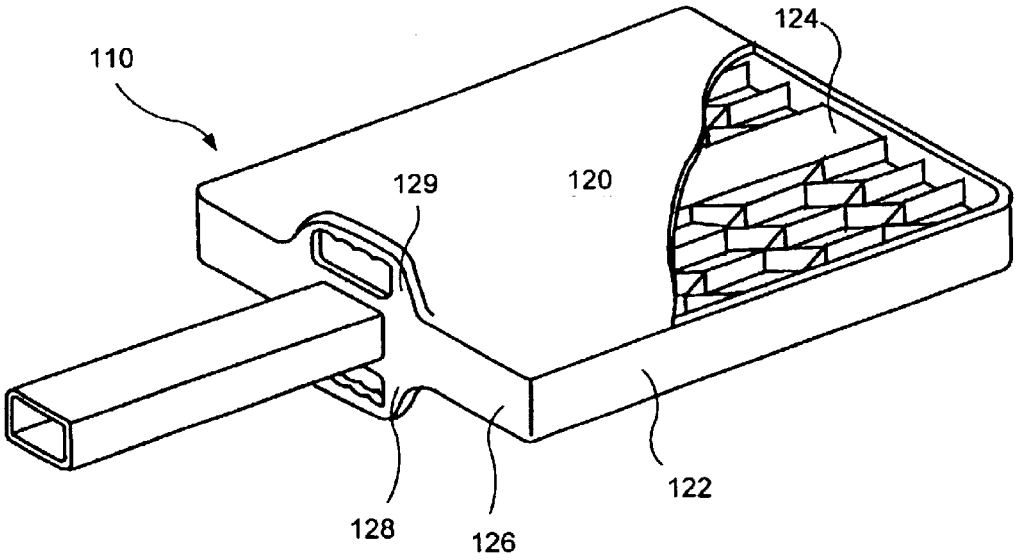
FIG. 8 is a perspective view from below of the embodiment shown in FIG. 6 with the lower tray partially broken away to show the honeycomb support structure therein.

When a device such as the one shown in the drawings is molded from a thermoplastic, reinforced thermoplastic, or other moldable material, an undergirding support structure is constructed to accommodate loads. In the second embodiment this is shown in FIG. 8 and includes a honeycomb-type reinforcement 130 sandwiched between the top and the bottom of tray 120 and surrounding mounting shaft 124. Although shown in this configuration, it is understood that the support structure could take the form of ribs, vanes, corrugations and the like.

Figure 10:
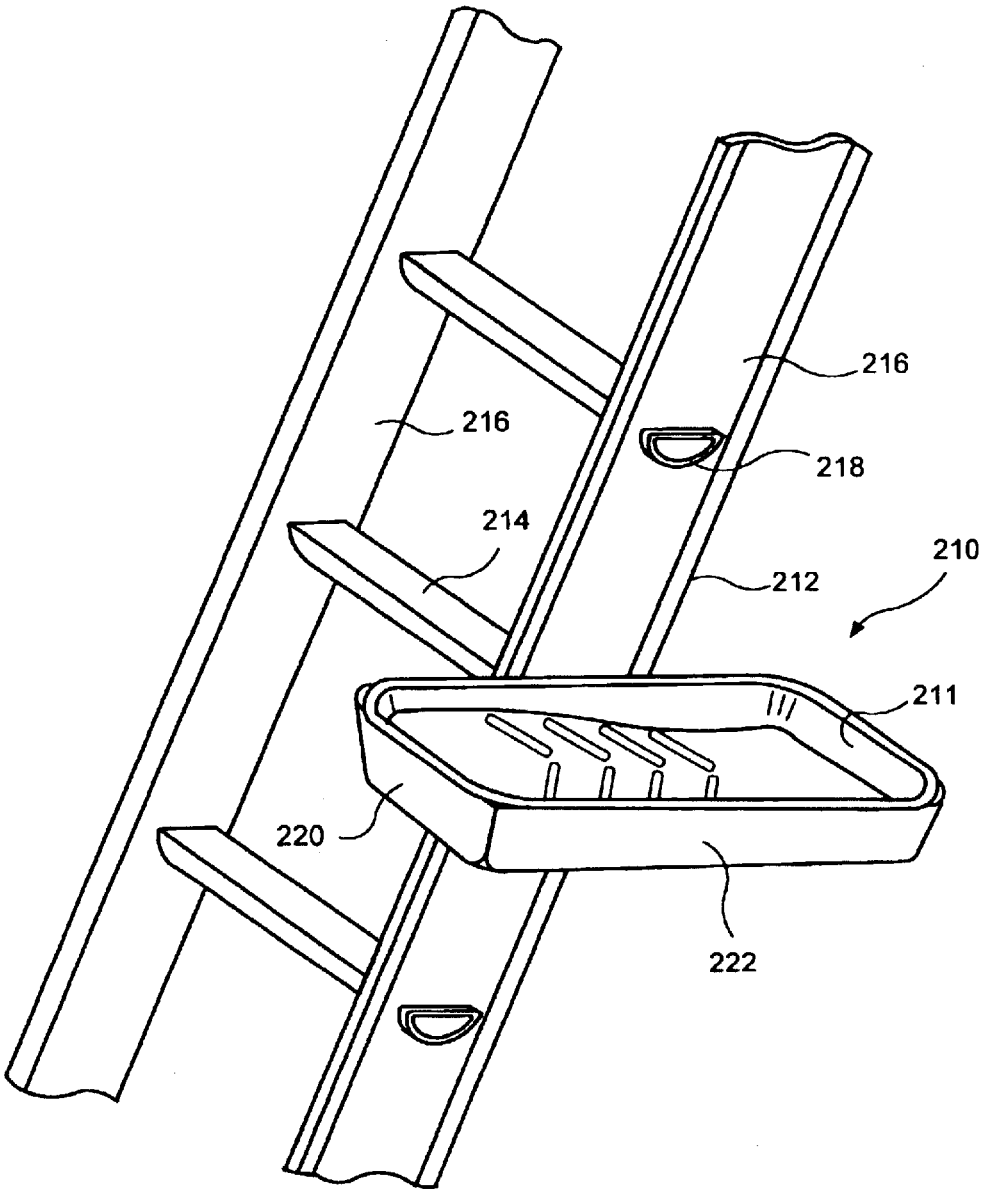

Referring now to FIG. 10, the third embodiment of this invention in which a standard paint tray holder, referred to generally by the reference designator 210, is shown. In this embodiment, similar parts to those of the first embodiment are referred to by reference designators 200 units higher than a similar part in the first embodiment. Thus, for example, the rim 22 in the first embodiment has an analogous rim 222 in the third embodiment.

The paint tray holder 210 is an application of the present invention to a standard paint tray 211 and accordingly has a rim opening of 11×15½ inches (approx.) and a rim height of 2¼ inches (approx.). As in the second embodiment, the paint tray holder 210 has a mounting shaft (not shown) extending from one side of the tray holder 210. In FIG. 10, the tray holding device 10 is mounted in D-rung 214 of ladder 212. The hollow D-rungs 214 extend between a pair of spaced apart side rails 216 and terminate on the outwardly facing sides of the rails 216 at D-rung openings or apertures 218. In ladder manufacture the ends of the D-rungs 214 are splayed outwardly and swaged over about a collar onto the side-rails so as to provide mechanically uniform entryways into the rung cavities. The mounting shaft is correspondingly shaped to fit within the respective the selected D-rung opening 218 and to slidingly engage the interior wall of the rung cavity.

Here, as in the prior embodiments, a light-weight tray holder 220 is formed from reinforced materials. The tray holder 220 hereof is equipped with an upstanding rim 222 about the perimeter thereof. Upon installation on a ladder in the operative position, the tray holder 210 of this embodiment is horizontal.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A tray holding device for mounting to a D-rung ladder having hollow rungs extending through a pair of spaced apart rails, said hollow rungs having outwardly facing D-shaped openings at the ends of the rung cavity, said tray holding device comprising, in combination:

a shaft and tray device, adapted for mounting on said ladder, being a unitary structure from a material selected from a group consisting of a thermoplastic and a reinforced thermoplastic, said shaft and tray device, in turn, comprising:

a shaft portion for, upon mounting to said ladder, slidably engaging the inner wall of said rungs cavity;

a tray portion contiguous with and attached to said shaft, and, when installed in said ladder in an operative position, said tray portion extending outwardly and substantially horizontally from one side thereof; and a tray support portion depending from said tray portion and undergirding said tray portion to increase the load capacity thereof;

a raised edge portion about and arising from the perimeter of said tray portion and adjacent juncture with said shaft;

a hand grip portion in said raised edge portion, upon mounting said holding device into said rung cavity, adapted to rest against said rail of said ladder;

said shaft portion is in cross-section configured to be inscribed within the D-shape of said D-shaped openings of said hollow rungs, said shaft slidably engaging both the flat side of said D-shape and the curved side of said D-shape; and a raised edge portion about and arising from the perimeter of said tray portion and adjacent said shaft;

a hand grip opening in said raised edge portion, upon mounting said holding device into said rung cavity, said hand grip opening adapted to rest against said rail of said ladder;

said shaft portion has a cross-section configured to be inscribed within the D-shape of said D-shaped openings of said hollow rungs, said shaft slidably engaging both the flat side of said D-shape and the curved side of said D-shape.

2. A tray holding device as described in claim 1 wherein said shaft portion in the relaxed state is slightly bowed and, upon insertion into said rung cavity straightens and exerts flexural tension against the inner wall thereof.

3. A tray holding device as described in claim 2 wherein said shaft portion is D-shaped in cross-section and configured to telescopically fit within said D-shaped openings of said hollow rungs.

4. A tray holding device as described in claim 3 wherein said tray support portion is a plurality of ribs undergirding said tray portion.

5. A tray holding device as described in claim 3 wherein said portion support structure is a honeycomb structure underlying said portion.

6. A tray holding device as described in claim 3 wherein said device is adapted for use with said ladder in an operative position, said tray holding device further comprising:

a shaft-to-tray connector portion adapted to dispose the upper surface of said tray portion horizontal when said tray holding device is inserted into one of said D-shaped openings of a ladder in said operative position.

7. A tray holding device as described in claim 6 wherein said opening portion is adapted to facilitate one-handed mounting and demounting enabling the operator to hold onto the ladder with the free hand.

8. A tray holding device for mounting to a D-rung ladder having hollow rungs extending through a pair of spaced apart rails, said hollow rungs having outwardly facing D-shaped openings at the ends of the rung cavity, said tray holding device comprising:

a shaft and tray device, adapted for mounting on said ladder, being a unitary structure from a material selected from a group consisting of a thermoplastic and a reinforced thermoplastic, said shaft and tray device, in turn, comprising:

a shaft portion for, upon mounting to said ladder, slidably engaging the inner wall of said rungs cavity;

a tray portion contiguous with and attached to said shaft, and, when installed in said ladder in an operative position, said tray portion extending outwardly and substantially horizontally from one side thereof; and a tray support portion depending from said tray portion and undergirding said tray portion to increase the load capacity thereof a raised edge portion arising from the side of said tray portion and adjacent with said shaft;

a hand grip opening in said raised edge portion, said hand grip opening, upon mounting said holding device into said rung cavity, adapted to rest against said rail of said ladder; and, said shaft portion is D-shaped in cross-section and configured to telescopically fit within said D-shaped openings of said hollow rungs.

9. A tray holding device as described in claim 8 wherein said shaft portion in the relaxed state is slightly bowed and, upon insertion into said rung cavity straightens and exerts flexural tension against the inner wall thereof.

10. A tray holding device as described in claim 8 wherein said tray support portion is a plurality of ribs undergirding said portion.

11. A tray holding device as described in claim 8 wherein said device is adapted for use with said ladder in an operative position, and wherein tray portion has an upper surface and a lower surface said tray holding device further comprising:

a shaft-to-tray connector portion adapted to dispose said upper surface of said tray portion horizontal when said tray holding device is inserted into one of said D-shaped openings of a ladder in said operative position.

12. A tray holding device as described in claim 11 wherein said hand opening portion is adapted to facilitate one-handed mounting and demounting enabling the operator to hold onto the ladder with the free hand.

* * * * *